US007267343B2

(12) United States Patent
Schreiner

(10) Patent No.: US 7,267,343 B2
(45) Date of Patent: Sep. 11, 2007

(54) METHOD FOR PLAYING A BLACKJACK GAME

(76) Inventor: Norman Schreiner, 2163 Harlans Run, Naples, FL (US) 34105

( * ) Notice: Subject to any disclaimer, the term of this patent is extended or adjusted under 35 U.S.C. 154(b) by 210 days.

(21) Appl. No.: 11/002,759

(22) Filed: Dec. 2, 2004

(65) Prior Publication Data

US 2006/0119042 A1 Jun. 8, 2006

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

| | | | | |
|---|---|---|---|---|
| 5,413,353 | A | 5/1995 | Demarest et al. | |
| 5,518,249 | A | 5/1996 | Sines et al. | |
| 5,639,092 | A | 6/1997 | Macaisa | |
| 5,720,483 | A | 2/1998 | Trinh | |
| 5,810,360 | A | 9/1998 | Srichayaporn | |
| 5,871,213 | A * | 2/1999 | Chadband et al. | 273/292 |
| 5,979,897 | A | 11/1999 | Grossman | |
| 6,279,910 | B1 * | 8/2001 | de Keller | 273/292 |
| 6,283,474 | B1 * | 9/2001 | de Keller | 273/274 |
| 6,575,465 | B2 | 6/2003 | Lo | |
| 6,719,291 | B1 * | 4/2004 | deKeller | 273/274 |
| 6,986,514 | B2 * | 1/2006 | Snow | 273/292 |
| 2002/0195775 | A1 | 12/2002 | Webb et al. | |
| 2006/0237912 | A1 * | 10/2006 | Walker et al. | 273/292 |
| 2006/0279045 | A1 * | 12/2006 | Thomas et al. | 273/292 |
| 2006/0281536 | A1 * | 12/2006 | Wright | 463/25 |
| 2007/0001397 | A1 * | 1/2007 | Walker et al. | 273/292 |
| 2007/0001398 | A1 * | 1/2007 | Walker et al. | 273/292 |

* cited by examiner

*Primary Examiner*—Eugene Kim
*Assistant Examiner*—Dolores R. Collins
(74) *Attorney, Agent, or Firm*—The Livingston Firm; Edward M. Livingston; Angela M. Miller

(57) ABSTRACT

A method for playing a blackjack game wherein players compete against one another, rather than a dealer, to win. A player may win by having a blackjack, a double blackjack or 21. If a player does not have a blackjack, double blackjack or 21, the player whose hand value is closest to 21 than that of any other players of the game wins. If two or more players have the same total, then the player with the most number of cards in his hand wins. If the total value and number of the cards are the same, the hand with the highest ranking black card, which is the card closest to the blackjack, wins the pot. Other variations of the game include a blackjack pot and a super jackpot wherein a player wins if he or she has a predetermined hand. The game may be played with or without a conventional gaming establishment dealer.

15 Claims, 5 Drawing Sheets

METHOD FOR PLAYING A BLACKJACK GAME

BACKGROUND OF THE INVENTION

This invention relates to blackjack, more specifically, a method for playing a blackjack game wherein players of the game compete against one another, rather than a dealer or "house."

Many people are familiar with the game of blackjack because of its simplistic rules wherein each card has an assigned value (an Ace may count as a 1 or 11, the cards valued from 2-9 are valued as indicated and the 10, Jack, King and Queen are valued at 10) and the sum of the cards must have a value that is closer to 21 than that of the dealer, without going over 21, in order to win. The suits of the cards are of no relevance in the game, nor is the presence of other players as each player strictly competes against the hand of the dealer only.

Each player places a bet and, along with the dealer, initially receives two cards, one face up and one face down. A player may draw additional cards (called a "hit") or may stand on the cards at his or her preference. The dealer must draw additional cards until he or she reaches a minimum value of 17. A blackjack occurs when a player or the dealer receives an ace and a face card or ten. While a blackjack by a player typically pays one and a half times the player's initial bet, a blackjack by the dealer instantly ends the game, causing each player to lose.

Although blackjack is currently one of the most popular card and casino games, it is limited in the fact that each player competes only against one other player, the dealer, thereby making the game somewhat blase. Moreover, a player's winnings in blackjack are also limited as he or she only stands to gain a predetermined amount of money in relation to how much money he or she initially bets.

Thus, a need exists for a new method of playing a blackjack game that brings excitement back to the game of blackjack by permitting players to compete against one another, rather than only against a dealer, thereby increasing the level of competitiveness in the game. Moreover, because more players are betting that his or her hand is better than another player's, the amount of money he or she stands to gain from a win is also increased substantially.

The relevant prior art includes the following patents:

| Patent No. (U.S. unless stated otherwise) | Inventor | Issue Date |
|---|---|---|
| 5,413,353 | Demarest et al. | May 09, 1995 |
| 5,810,360 | Srichayaporn | Sep. 22, 1998 |
| 5,720,483 | Trinh | Feb. 24, 1998 |
| 6,719,291 | deKeller | Apr. 13, 2004 |
| 6,283,474 | de Keller | Sep. 04, 2001 |
| 6,279,910 | de Keller | Aug. 28, 2001 |
| 5,639,092 | Macaisa | Jun. 17, 1997 |
| 5,871,213 | Chadband et al. | Feb. 16, 1999 |
| 2002/0195775 | Webb et al. | Dec. 26, 2002 |
| 6,575,465 | Lo | Jun. 10, 2003 |
| 5,518,249 | Sines et al. | May 21, 1996 |
| 5,979,897 | Grossman | Nov. 09, 1999 |

SUMMARY OF THE INVENTION

The primary object of the present invention is to provide a method for playing blackjack wherein each player competes against other players, rather than against a dealer.

Another object of the present invention is to provide a method for playing blackjack wherein the suit of the cards is of relevance to the game.

A further object of the present invention is to provide a method for playing blackjack wherein a pot may or may not be limited.

An even further object of the present invention is to provide a method for playing blackjack wherein a jackpot may or may not be utilized.

Another object of the present invention is to provide a method for playing blackjack wherein the number of cards in a hand is of relevance to the game.

A further object of the present invention is to provide a method for playing blackjack that is simple to play.

An even further object of the present invention is to provide a method for playing blackjack that is fun to play.

Another object of the present invention is to provide a method for playing blackjack that is challenging.

A further object of the present invention is to provide a method for playing blackjack that involves strategy.

The present invention fulfills the above and other objects by providing a method for playing a blackjack game wherein a player must have a blackjack or a hand value that is closer to 21 than that of any other player of the game, without going over 21, in order to win. Thus, the players are competing against one another, rather than the dealer. If two or more players have the same total, the player with the most number of cards in his hand wins the pot. If the total value and number of the cards are the same, the hand with the highest ranking black card, which is the card closest to the black jack, wins the pot.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
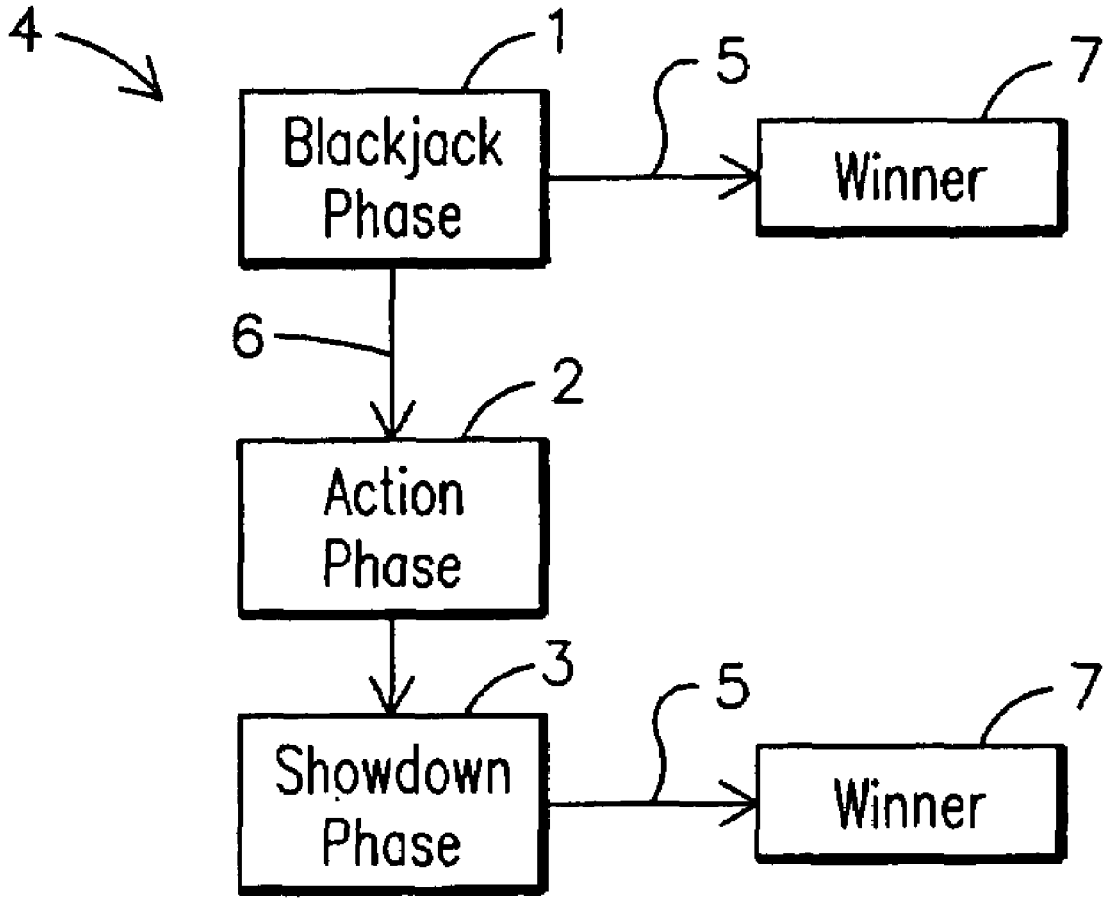
FIG. 1 is a flow diagram representing the phases of the present invention.

For purposes of describing the preferred embodiment, the terminology used in reference to the numbered components in the drawings is as follows:

| | |
|---|---|
| 1. | blackjack phase |
| 2. | action phase |
| 3. | showdown phase |
| 4. | method for playing a blackjack game |

-continued

| | |
|---|---|
| 5. | player has a winning hand |
| 6. | no player has a winning hand |
| 7. | winner |
| 8. | start game |
| 9. | all players post ante into a blackjack pot |
| 10. | player to left of dealer posts small blind |
| 11. | player to left of small blind posts big blind |
| 12. | dealer deals two cards to each player |
| 13. | does any player have a double blackjack? |
| 14. | does one or more player have an Ace and a face card? |
| 15. | player with highest ranking black card wins |
| 16. | peek |
| 17. | each player, beginning with first position, calls, raises or folds |
| 18. | collect main pot and blackjack pot |
| 20. | beginning with player left of the dealer, each player performs an action |
| 21. | does at least one player have a black card? |
| 22. | if sum over 21, player busts |
| 23. | player(s) win or split main pot |
| 24. | split if player has pair of matching cards |
| 25. | is sum equal to or below 21? |
| 26. | player busts; costs ante |
| 27. | cost equal to two times ante |
| 28. | player who betted last or, if all players checked, player who checked first must show cards first |
| 29. | remaining players show cards |
| 30. | collect main pot |
| 33. | determine which player(s) has the hand closest to 21 inclusive |
| 34. | is there only one player with this value? |
| 35. | determine which player has the most amount of cards |
| 36. | move dealer-button to the left |
| 37. | ranking order |
| 38. | jack of spades |
| 39. | jack of clubs |
| 40. | queen of spades |
| 41. | queen of clubs |
| 42. | king of spades |
| 43. | king of clubs |
| 44. | ace of spades |
| 45. | ace of clubs |
| 46. | 10 of spades |
| 47. | 10 of clubs |
| 48. | 9 of spades |
| 49. | 9 of clubs |
| 50. | 8 of spades |
| 51. | 8 of clubs |
| 52. | 7 of spades |
| 53. | 7 of clubs |
| 54. | 6 of spades |
| 55. | 6 of clubs |
| 56. | 5 of spades |
| 57. | 5 of clubs |
| 58. | 4 of spades |
| 59. | 4 of clubs |
| 60. | 3 of spades |
| 61. | 3 of clubs |
| 62. | 2 of spades |
| 63. | 2 of clubs |
| 64. | hit |
| 65. | stand |
| 66. | double down |
| 70. | players split main pot and blackjack pot |
| 72. | re-split |

-continued

| | |
|---|---|
| 73. | cost equal to three times ante |
| 74. | bet or check |
| 76. | is there only one player with this amount of cards? |
| 77. | does a player have 21? |
| 78. | do multiple players have 21? |

With reference to FIG. 1, a flow diagram representing the phases of the present invention is shown. The method for playing a blackjack game 4 consists of a blackjack phase 1, an action phase 2 and a showdown phase 3. A winner 7 may collect if he or she has the winning card hand during the blackjack phase 1 or after the action phase 2 and showdown phase 3. Preferably, the game is played employing two to ten players.

Figure 2:
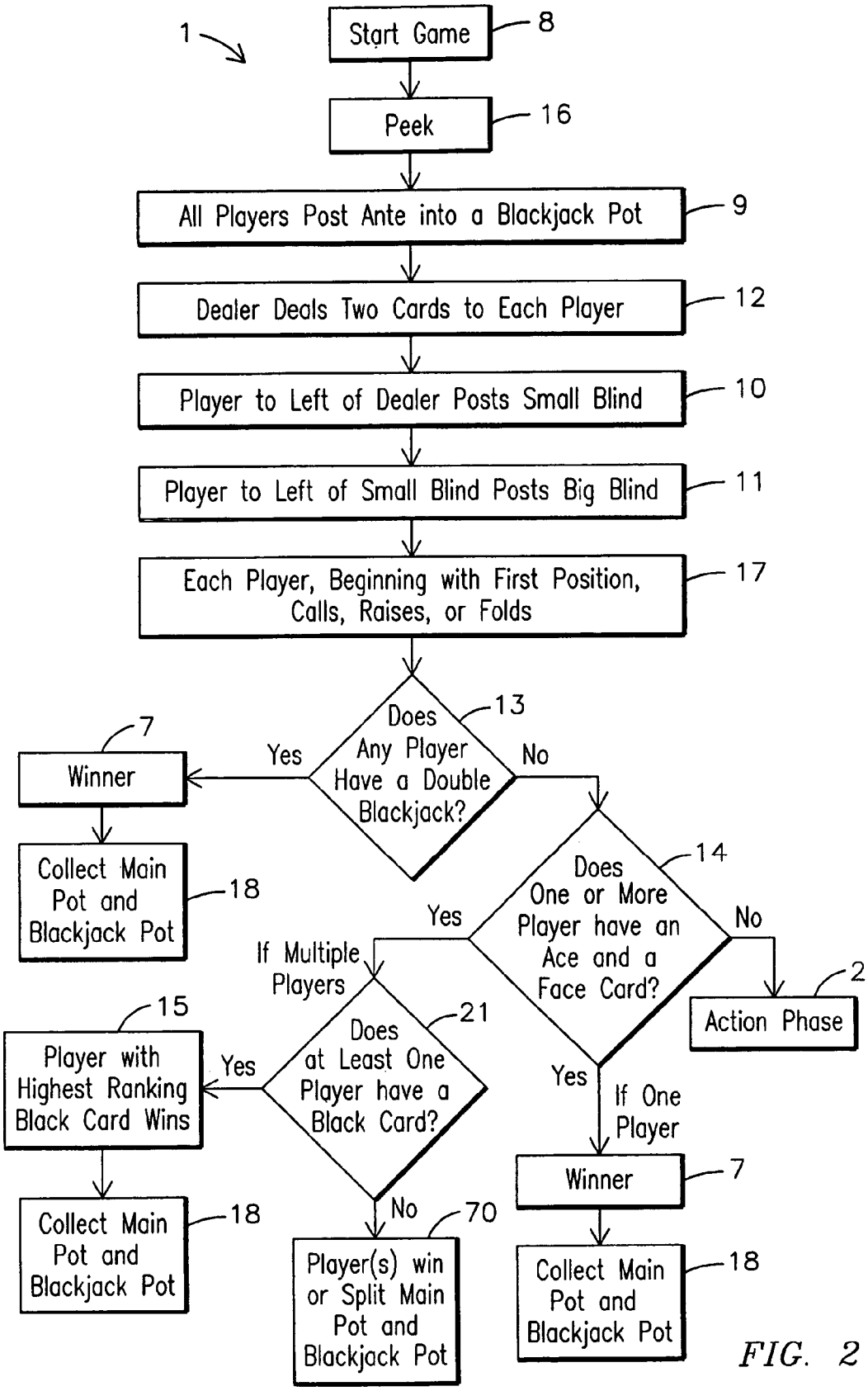
FIG. 2 is a flow diagram representing a blackjack phase of the present invention.
Figure 3:
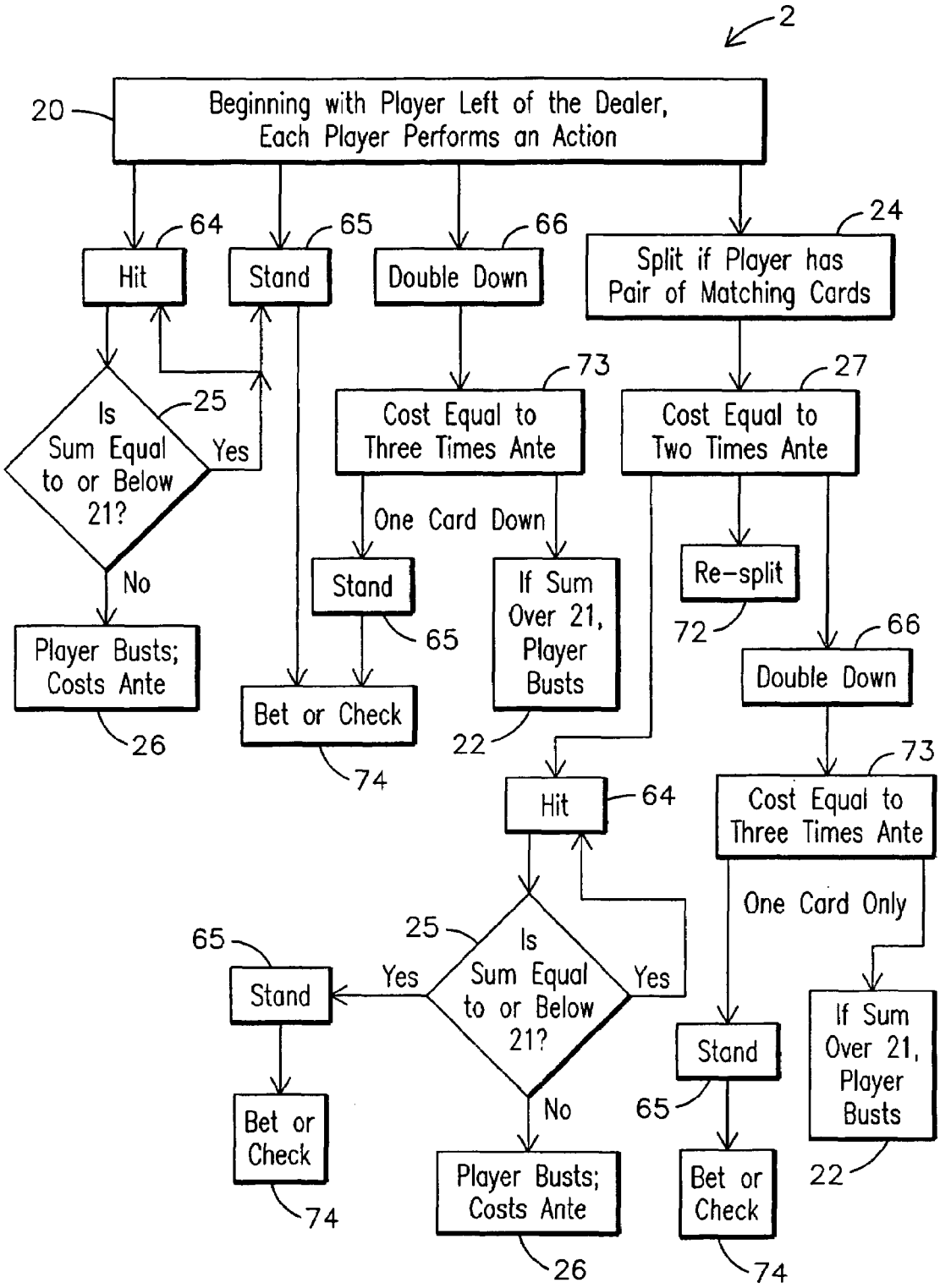
FIG. 3 is a flow diagram representing an action phase of the present invention.
Figure 4:
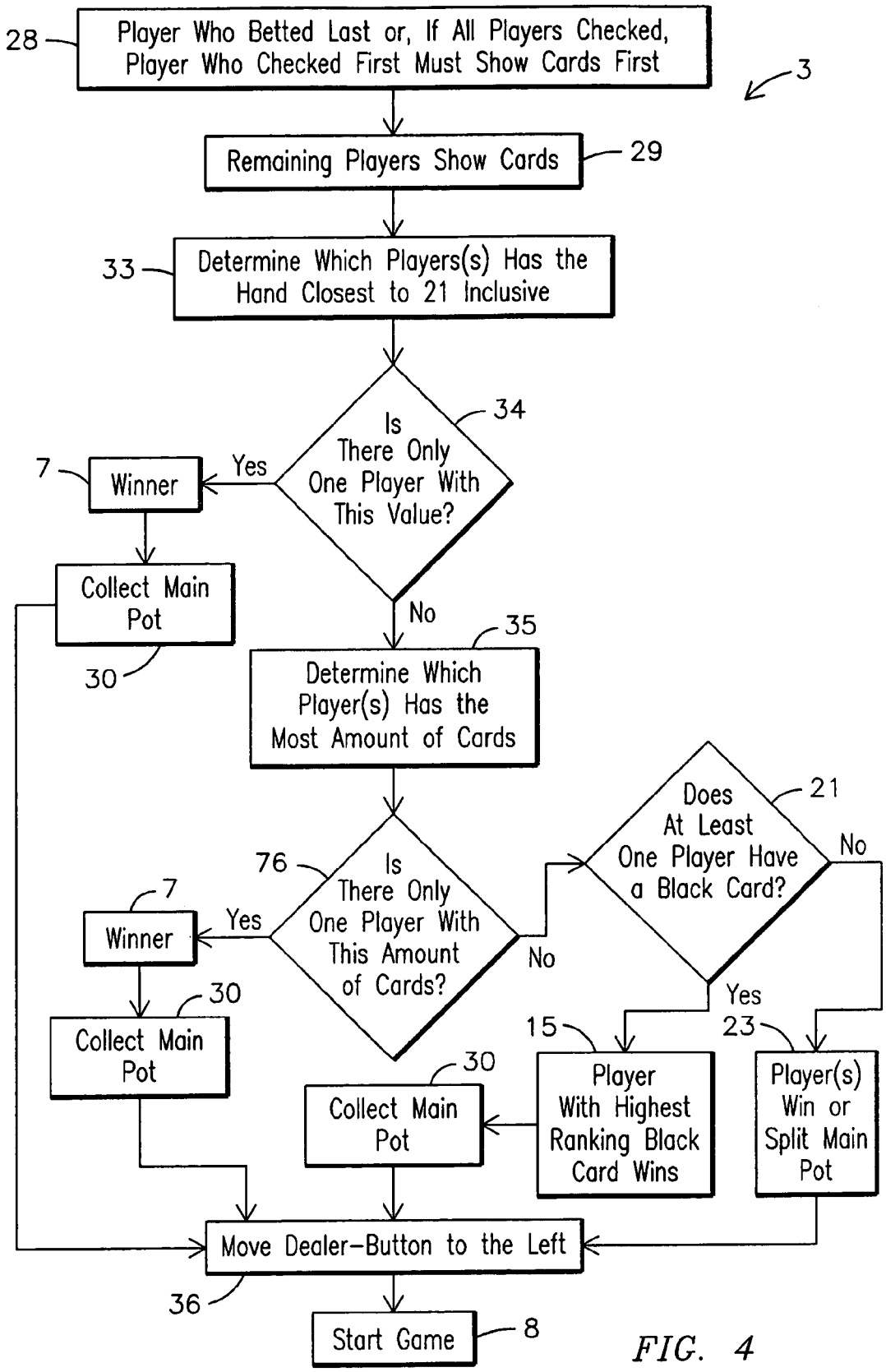
FIG. 4 is a flow diagram representing a showdown phase of the present invention.

With reference to FIGS. 2-4, flow diagrams of the blackjack phase 1, action phase 2 and showdown phase 3 are shown.

The present invention is preferably to be employed at gaming establishments, although it may be played within the less formal establishments, such as a home. The present invention may be played on gaming tables typically used for card games, including standard blackjack, although any table may suffice. Chips, tokens, coins, bills or any other item may be used for currency and preferably one standard fifty-two card playing deck is used during the play of the present invention.

If the present invention is being played at a gaming establishment, the dealer will be utilized to deal the cards only (he or she may not actively participate in the game and is thus not an active player). If the present invention is being played within a less formal establishment, each player within the game acts as a dealer, although the dealer/player 31 will still be permitted to compete in the game as an active player. A "dealer-button" is used to indicate the theoretical dealer of each hand. After each hand is completed, the button moves clockwise to the next active player wherein this player is now considered "the dealer" for that hand 36 and must generate a new deck of cards for the hand.

To start the game 8 of the first round of the present invention, also known as "the blackjack phase" 1, a card is buried face up under the deck by the dealer, which is called a "peek" 16. Then, each player must initially place an ante into a blackjack pot 9, which is preferably 10% of the upper stake. In the present example, the ante will be $1.00. The dealer deals two cards to each active player 12 wherein one card is face up and the other is face down.

Then, the player to the left of the dealer posts the small blind 10, which is preferably equal to the lower stake. For example, at a $5.00-$10.00 limit game, the small blind would be $5.00. Although this is the suggested set-up of the small blind, other set-ups may be used.

Next, the player to the left of the small blind posts a "big blind" 11, which is preferably equal to one and a half (1½) times the lower stake. Although one big blind is initially posted, if a person joins a table at which a game is in play, this person must also post a big blind. This person has the option of placing the big blind at the start of the next hand or waiting for his or her turn, as decided by the movement of the dealer-button, to place the big blind. All of the blinds, both small and big, are considered "live bets" and the players who posted them will have the option of checking, calling, raising or folding when the betting returns to his or her position.

After the blinds have been posted, each player, beginning with the first position (which is the player to the left of the big blind), can either call, raise or fold 17 the stakes structure. For example, in a $5.00-$10.00 game of the present invention, the value of each bet is $5.00 for the first round. If a player chooses to "raise" a bet, the amount would be any amount up to the upper stake. The decision of each subsequent player to call, raise or fold is dependent upon the hand he or she is holding.

There are several ways to win the initial pot. First, a player may have a "double blackjack" 13, which is when he or she has the Jack of Spades and the Jack of Clubs. If a player has a double blackjack, then he or she is the winner 7 and he or she collects the main pot and the blackjack pot 18. If no players have a double blackjack, then the determination must be made to see if a player has an Ace and a face card 14. If no players have an Ace and a face card, then the players proceed to the action phase 2. However, if a single player does have an Ace and a face card, then he or she is determined the winner 7 and collects the main pot and the blackjack pot 18. If multiple players have an Ace and a face card 19, then the determination must be made as to whether at least one player has a black card 21. If at least one player has a black card, then the player with the highest ranking black card wins 15 and collects the main pot and the blackjack pot 18. If no players have a black card, then the player or players with both red cards win or split the main pot and the blackjack pot 70. At any time during the course of the game, a player may bluff and raise the stakes, thereby causing other players to believe the bluffer has an exceptional hand and fold. If the bluffing is done in the blackjack phase 1 and every player except for the bluffer folds, the game does not proceed to the action phase 2 and the bluffer wins only the main pot and not the blackjack pot. However, bluffing is not required in the game, although it does make the game more interesting and exciting.

During the next phase, called "the action phase" 2, each player must perform an action 20; that is, each player must either hit 64 (take another card), stand 65 (remain) or "double down" 66 (see description below). Additionally, if a player has the capability, he or she may split a matching pair of cards 24 into two separate hands to be played independently. The player to the left of the dealer performs his or her action first.

When a player chooses to hit 64, he or she will hold the first two cards with one hand and scrape the cards across the table lightly in order to request another card. The dealer will then deal the additional card(s) in front of the player's bet. The player simply adds the value of the newly drawn card to his or her total hand value while leaving the cards on the table. If the sum of the player's hand is equal to or below 21 25, then the player has the option to hit 64 or stand 65. If the player goes over 21, he or she busts wherein the cost is the ante 26 and must turn the cards in his or her hand face down on the table. Thus, the player places an amount equal to the ante, e.g., $1.00, into a super jackpot, or if not utilizing a super jackpot option, the main pot.

When a player chooses to stand 65, he may then bet or check 74 (bypass his or her turn without placing a bet), he or she should tuck the currently held cards under the chips that he or she is using to bet. If the player is showing more than 12 points on the face up cards, the dealer will orally confirm that the player has not miscounted by making an announcement, such as "Player stands showing 14—has seven or less" or "Player stands showing 16—has 5 or less." Such announcements will protect the table from a player miscounting his or her cards, betting, forcing other players to fold and then realizing that he or she has a count of more than 21. Such announcements are necessary for the play of the present invention.

Among the more profitable options a player has is the choice to double down 66. This option can only be utilized when a player has a two card hand usually totaling eleven. Doubling down allows the player to double his or her bet and receive only one additional card to the hand. A cost equal to three times the ante 73 is preferably placed into the main pot and then, the player receives one card face down. The player either stands 65 and bets or checks 74 or, if the sum is over 21, the player busts 22.

The player simply tosses the two cards face-up onto the table in front of him or her, costing an amount equal to three times the ante. The dealer will then deal one additional card to the hand. The dealer should tuck the additional card face-down under the player's card for revelation at a later time. At this point, the player has the option to check or bet any amount equal to the lower stake up to two times the amount of the upper stake. The option of betting the increased amount is given to that player who doubled down only and any bet made by another player can only be an amount between the lower stake and the upper stake, inclusive.

When a player is dealt a matching pair of cards, he or she has the ability to split the hand 24 into two separate hands and play them independently. If a hand is split, the cost is equal to two times the ante 27, which is preferably placed into the main pot, and the player can either hit 64, re-split 72 or double down 66. If the player hits 64, then he or she must hit the highest ranking card first. The ranks are described below. The player then plays the first hand to completion, at which pont the dealer will deal a second card to the second hand. Another option is to allow a player to double down on one of the newly separated hands, called a "double after split", and continue as with a regular double down. If you get a matching card after the split, another option is to re-split 72, making yet another hand. The most common rule allows a player to split up to three times, thereby making four separate hands. Finally, if a player splits a pair of Aces and draws a face card on one of the split Aces, the hand is not considered a blackjack, but rather is treated as 21. If the player draws a 10 on one of the Aces, it is considered 21 or 11 and the player may then double down.

If a player splits a pair of face cards and the player receives an Ace, then the hand is considered to be 21 and not a blackjack. A black jack on a black jack after a split is considered only twenty and not a double blackjack.

If a player goes over 21, he or she busts 26 and must then place an amount equal to the ante into the main pot or a super jackpot. The busted player's option to bet or check is not passed onto the next player.

Figure 5:
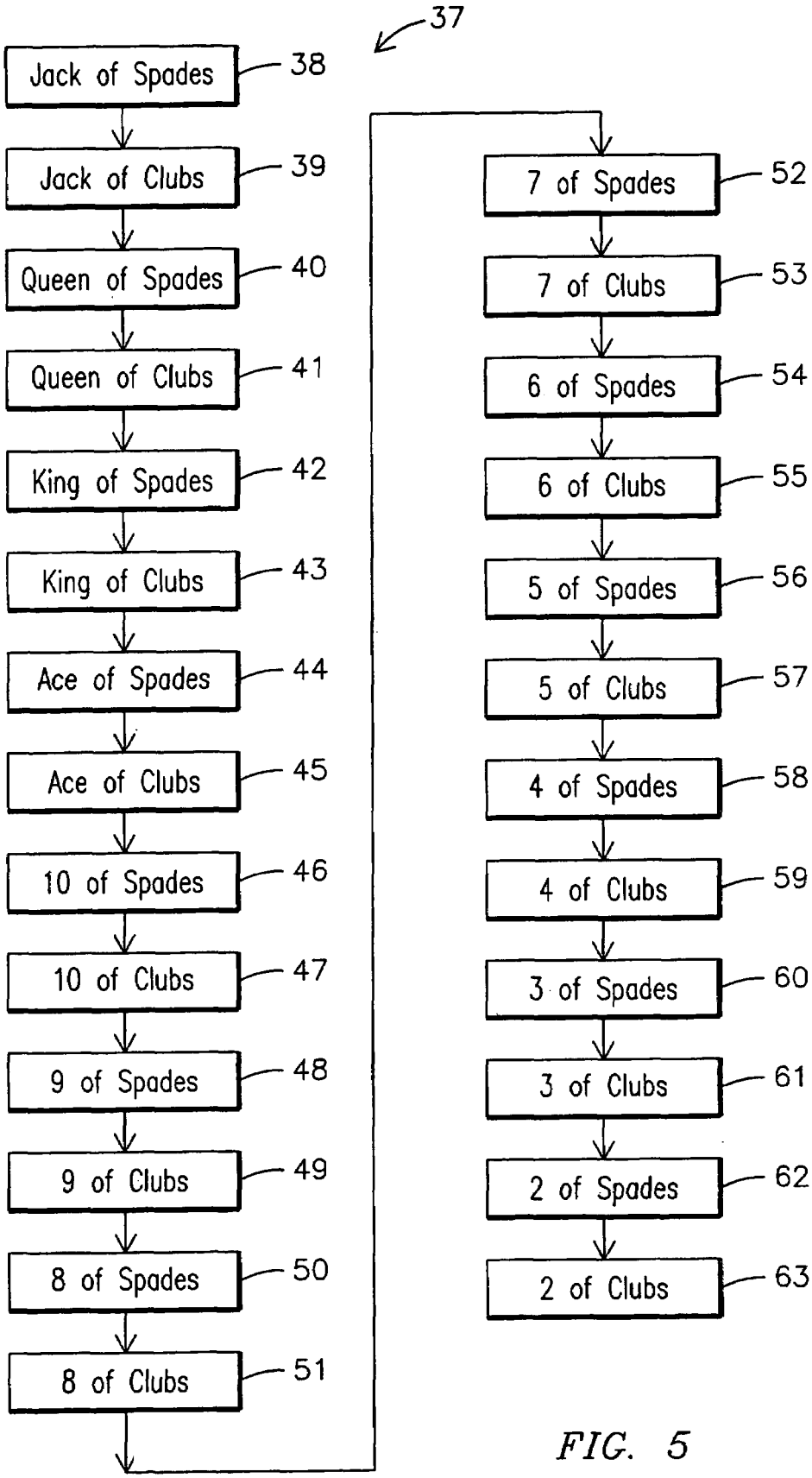
FIG. 5 is a block diagram representing a ranking order of the present invention.

The cards are ranked in descending order as shown in FIG. 5, which is a flow diagram representing the ranking order 37, as follows: Jack of Spades 38, Jack of Clubs 39, Queen of Spades 40, Queen of Clubs 41, King of Spades 42, King of Clubs 43, Ace of Spades 44, Ace of Clubs 45, 10 of Spades 46, 10 of Clubs 47, 9 of Spades 48, 9 of Clubs 49, 8 of Spades 50, 8 of Clubs 51, 7 of Spades 52, 7 of Clubs 53, 6 of Spades 54, 6 of Clubs 55, 5 of Spades 56, 5 of Clubs 57, 4 of Spades 58, 4 of Clubs 59, 3 of Spades 60, 3 of Clubs 61, 2 of Spades 62 and 2 of Clubs 63. At all times during play of the game, a Spade outranks a Club. If there are no black cards, a red hand can win the pot. However, if two or more players have only red cards, the pot is split between them.

After each round of betting, the play moves to the next player until the last player chooses his or her action. After the last player acts on a hand by either standing or splitting or doubling down, the players move on to a showdown phase 3. The player who bets last, or if all players checked, the player who checked first, is required to show his or her cards first 28 at the showdown phase 3. Regardless if he or she has the best hand, the remaining players must show their cards 29. The aggressors' hand is only turned over first if he was the last to initiate the action. The cards are then compared to determine a winner.

The first determination is which player(s) have then hand closest to 21 inclusive 33. Then, the question becomes whether there is only one player with this value 34. If there is only one player with this value, then he or she is the winner 7 and he or she collects the main pot 30. If there is more than one player with this value, then the determination must be made as to which player(s) have the most amount of cards 35 and whether there is only one player with this amount of cards 76. If there is only one player with this amount, then he or she is the winner 7 and collects the main pot 30. If there is more than one player with this amount of cards, then the question remains as to whether at least one player has a black card 21. If at least one player does have a black card, then the player with the highest ranking black card wins 15 and collects the main pot 30. If no player(s) have a black card, then the player(s) have only red cards and must therefore win or split the main pot 23.

After the pots are collected 23 or 30, the dealer button is moved to the left 36 and a new game is started 8.

In addition, there are some standard rules for the present invention. Although these rules are preferable, they are not necessary for the proper game play of the present invention and may be altered according to the players' preferences.

First, a maximum of four bets, which includes one bet and three raises, are allowed for each betting round per player. The term "cap" is used to describe the final raise in a round since betting then capped and no other player may make another raise. Once capped, the players will have the option of calling or folding only. Folding can be done at any stage of the game and occurs when a player no longer wishes to participate in the game and loses any rights to the pot.

Second, the present invention is preferably a "table stakes" game, meaning only the chips in play at the beginning of each hand may be used throughout the hand. Essentially, this means that the player may not receive additional funds from a cashier while he or she is in the midst of the game. The table stakes rule has an application called the "All-In" rule, which states that a player cannot be forced to forfeit a hand because the player does not have enough chips to call a bet.

A player who does not have enough chips to call a bet is declared All-In. The player is eligible for the portion of the pot to the point of his or her final wager. All further action involving other players takes place in a "side pot", which is unavailable to the player who has already gone All-In. When a player goes All-In, the pot currently in the center of the table which has contributions from the All-In player, is treated as the main pot over which the All-In player has rights. After the player goes All-In, all the new bets are placed in a side pot over which only the contributing players have rights. The All-In player does not have any rights over the side pot and the side pot is given to the next winning combination.

Third, a player may try to win the pot by acquiring a "Kazzie", which is when a player has five or more cards in one hand totaling 21 points. A "Jack Kazzie" is when a player has five or more cards on one hand totaling 21 points wherein one of the cards is a Jack and a "Black Jack Kazzie" is when a player has five or more cards in one hand totaling 21 points and one of the cards is a black jack. However, if a player wins by having a Kazzie, Jack Kazzie or Black Jack Kazzie, he or she may win a larger pot than the main pot as it is more difficult for a player to obtain this specific combination of cards. A super jackpot may be used by securing a highly difficult to obtain hand of cards.

The determination of how much money is placed into a super jackpot is up to the gaming establishment or the players of the game.

Moreover, the gaming establishment or the players of the game may agree to have a main pot, a blackjack pot and a super jackpot. The super jackpot would allow for an even greater gain simply by a player securing a hand which is very difficult to attain. The super jackpot may be built by adding the costs associated with busting or any other action a player may take, such as doubling down or splitting a pair. Once again however, the determination as to whether to utilize these suggested super jackpot rules is to be determined by the gaming establishment or the players of the game.

Alternatively, the super jackpot could be won by a player securing a "straight 21", which is a player having a six card, a seven card and an eight card in one hand, also known as a "6-7-8." This gives a player having a 13, 14 or 15 card sum value in his or her first two cards an option to stay in the game, rather than folding.

In addition, the super jackpot could be won by a player securing a "slot 21", which is a player having three seven cards (7-7-7), even if the third 7 busts the hand; the player securing a "Kazzie", which is having a hand totaling 21 in five or six cards; and the player securing a "super straight", which is a player having an Ace, 2, 3, 4, 5, and 6 in one hand.

Although various pots are disclosed, the gaming establishment or players may agree to use only a main pot; a main pot and a blackjack pot; a main pot, blackjack pot and super jackpot; or any other combination thereof.

A gaming establishment may collect a predetermined rake on the game, such as a percentage and/or collect a percentage of the super jackpot. Moreover, since the present method for blackjack is a multi-player game, more money may be played during the course of the game in comparison to conventional blackjack.

Although only a few embodiments of the present invention have been described in detail hereinabove, all improvements and modifications to this invention within the scope or equivalents of the claims are included as part of this invention.

Having thus described my invention, I claim:

1. A method for playing a blackjack game using at least one standard deck of fifty-two playing cards employing at least two players, each of which may be a dealer, said method comprising the steps of:

a. the at least two players placing a predetermined wager as an ante into a blackjack pot;

b. the dealer dealing two cards to each of said at least two players at least one of said two cards being face down;

c. a first player to an immediate left of the dealer posting a small blind into a main pot;

d. a second player to an immediate left of the first player posting a big blind into a main pot;

e. each player, beginning with a first position, calling, raising or folding;

f. comparing each player's cards to determine if a player wins the blackjack game by having a double blackjack, and if no double blackjack, then an ace and a face card;

g. if a player has won in step f, then paying said blackjack pot and said main pot to the player and the game ends, but if no player has won, then the game proceeds to step h;

h. each player, beginning with the first player, performing an action;

i. comparing each player's cards to determine which player wins the blackjack game by having a hand closest to 21 inclusive; and j. paying said main pot to the player who wins the game.

2. The method of playing the blackjack game of claim 1 and further comprising a step before step g of determining the winning player to have an ace and a face card wherein at least the ace or the face card is a highest ranking black card according to a predetermined ranking order.

3. The method of playing the blackjack game of claim 2 wherein the predetermined ranking order is jack of spades, jack of clubs, queen of spades, queen of clubs, king of spades, king of clubs, ace of spades, ace of clubs, 10 of spades, 10 of clubs, 9 of spades, 9 of clubs, 8 of spades, 8 of clubs, 7 of spades, 7 of clubs, 6 of spades, 6 of clubs, 5 of spades, 5 of clubs, 4 of spades, 4 of clubs, 3 of spades, 3 of clubs, 2 of spades and 2 of clubs.

4. The method of playing the blackjack game of claim 1 and further comprising a step after step g of rotating an imaginary dealer button from player to player to determine a starting point for a deal of a next game.

5. The method of playing the blackjack game of claim 1 wherein no player is a dealer.

6. The method of playing the blackjack game of claim 1 wherein the action is to hit.

7. The method of playing the blackjack game of claim 1 wherein the action is to split a pair.

8. The method of playing the blackjack game of claim 1 wherein the action is to double down.

9. The method of playing the blackjack game of claim 1 wherein the action is to stand.

10. The method of playing the blackjack game of claim 1 wherein at least two players have a hand closest to 21 inclusive and said hand is equal, further comprising a step prior to step j of determining a winning player to have a greatest amount of cards.

11. The method of playing the blackjack game of claim 1 wherein at least two players have a greatest amount of cards and said amount is equal, further comprising a further step prior to step j of determining a winning player to have a highest ranking black card according to the predetermined ranking order of claim 3.

12. The method of playing the blackjack game of claim 1 further comprising a step before steps g and j of a player busting if the player has a sum over 21.

13. The method of playing the blackjack game of claim 12 wherein the player who busts must pay a predetermined amount of money into the main pot.

14. The method of playing the blackjack game of claim 13 wherein the player who busts must pay a predetermined amount of money into a super jackpot.

15. The method of playing the blackjack game of claim 1 wherein the blackjack pot accumulates if no player has a predetermined blackjack combination.

* * * * *